United States Patent [19]

Mizuta et al.

[11] Patent Number: 4,578,878

[45] Date of Patent: Apr. 1, 1986

[54] TOBACCO DRYING MACHINE

[75] Inventors: Yoshiaki Mizuta; Hisao Abe; Youichi Shibata; Yasunori Ohsawa; Osamu Bandou, all of Tokushima, Japan

[73] Assignee: The Japan Tobacco & Salt Public Corporation, Tokyo, Japan

[21] Appl. No.: 671,848

[22] Filed: Nov. 15, 1984

[30] Foreign Application Priority Data

Nov. 15, 1983 [JP] Japan ..... 58-213228

[51] Int. Cl.[4] ..... F26B 21/08

[52] U.S. Cl. ..... 34/46; 34/48; 34/54; 131/303; 131/305

[58] Field of Search ..... 34/46, 48, 54; 131/303, 131/304, 305

[56] References Cited

U.S. PATENT DOCUMENTS 3,785,765 1/1974 Rowell et al. .

3,948,277 4/1976 Wochnowski ..... 34/46

*Primary Examiner*—Larry I. Schwartz

*Attorney, Agent, or Firm*—Armstrong, Nikaido, Marmelstein & Kubovcik

[57] ABSTRACT

A tobacco drying machine of rotary cylindrical type having a steam pipe at the wall thereof and a heated air source at the lower side of a material supply inlet, comprises means for detecting the flow of tobacco raw material at a pretreatment process line of the drying machine; a water spraying nozzle at the raw material supply inlet into which pressurized air is supplied as a carrier; and a control circuit for providing a signal to the water spraying nozzle when a predetermined period of time has passed since said circuit received a signal representative of the passage of the front or rear end of the tobacco raw material through the detector.

14 Claims, 3 Drawing Figures

TOBACCO DRYING MACHINE

BACKGROUND OF THE INVENTION

The present invention relates to a rotary cylindrical tobacco drying machine and in particular to an improvement in the technology for preventing the excessive drying of the front and rear ends of the tobacco raw material flow in a drying machine.

Prior art rotary cylindrical tobacco drying machine is known in which a heat source for drying is automatically controlled in response to signals from moisture and weight provided at pretreatment and post-treatment process lines for providing uniformly dried tobacco leaves. Japanese Patent Publication No. 50-6556 discloses an apparatus in which a drying heat source is constantly maintained and the amount of water sprayed into an exit of the drying machine is controlled in response to a signal from a moisture meter at a post-treatment process line of the drying machine.

However these drying machines mainly aim at control at steady state and cannot sufficiently prevent excessive drying at unsteady state such as front and rear ends of the material flow.

SUMMARY OF THE INVENTION

It is therefore an object of the present invention to provide a novel drying machine in which the problem of the prior art is overcome.

It is another object of the present invention to provide a tobacco leaves drying machine in which the excessive drying of the front and rear ends of the tobacco material flow is prevented.

In an aspect of the present invention there is provided a tobacco drying machine of rotary cylindrical type having a steam pipe at the wall thereof and a heated air source at the lower side of a material supply inlet, said machine comprising means for detecting the flow of tobacco raw material at a pretreatment process line of the drying machine; a water spraying nozzle at the raw material supply inlet into which pressurized air is supplied as a carrier; and a control circuit for providing a signal for spraying water from the nozzle when a predetermined period of time has passed since said circuit received a signal representative of the passage of the front or rear end of the tobacco raw material flow through the detector.

In another aspect of the present invention there is provided a tobacco drying machine of rotary cylindrical type having a steam pipe at the wall thereof and a heated air source at the lower side of a material supply inlet, said machine comprising means for detecting the flow of tobacco raw material at a pretreatment process line of the drying machine; a water spraying nozzle at the raw material supply inlet into which pressurized air is supplied as a carrier; and a control circuit for providing a signal for spraying water from the nozzle when a predetermined period of time has passed since said circuit received a signal representative of the passage of the front or rear end of the tobacco raw material flow through the detector and for providing a signal to the heated air source for increasing the flow rate of the blown air when a predetermined period of time has passed since the control circuit received a signal representative of the passage of the rear end of the flow of the tobacco raw material through the detector.

In accordance with present invention, excessive drying at unsteady state can be substantially prevented.

Since water is sprayed to the tobacco raw material at the material supply side of the drying machine, the break of the raw material which is stirred within the drying machine while being excessively dried and the reduction of flavor (particularly increase in stimulation) may be prevented.

DETAILED DESCRIPTION OF THE INVENTION

Figure 1:
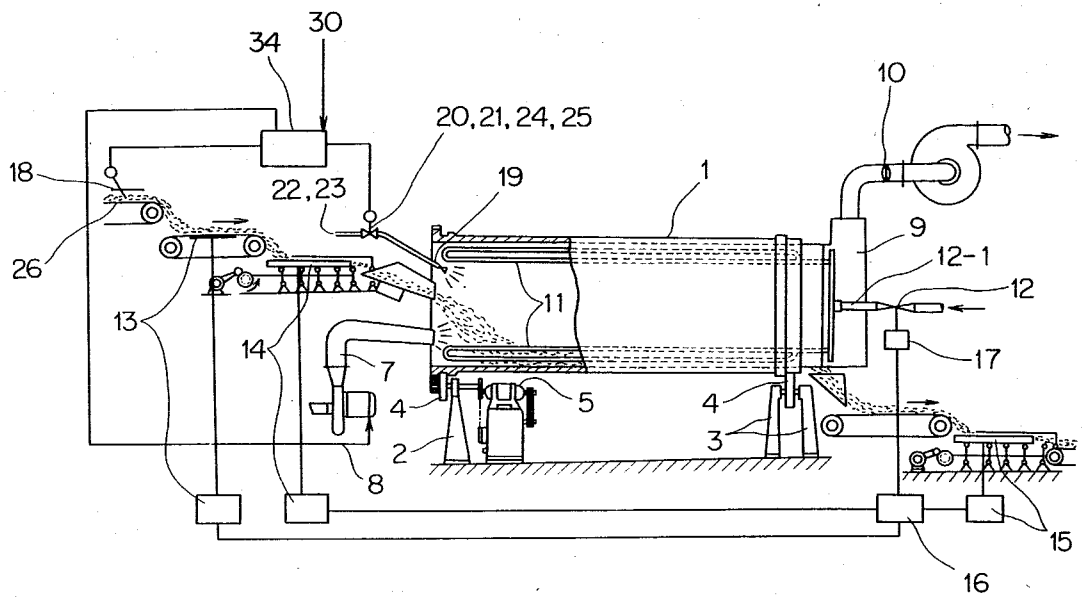
FIG. 1 is a schematic side view showing an embodiment of the present invention.

An embodiment of the present invention will be described with reference to the drawings.

A cylindrical tobacco leaves drying machine (hereinafter referred to as a drying machine) 1 is supported on rollers 4 which are journalled by stands 2 and 3. The drying machine 1 is adapted to be rotated by a motor 5 via the rollers 4. A heated air supply duct 7 is disposed at the entrance of the drying machine 1. Heated air is supplied by a fan 8 disposed along the duct 7 for expelling wet air. A hood 9 is provided at the exit of the drying machine 1 for sucking wet air from the drying machine 1. An exhaust duct 10 is provided at the upper portion of the hood 9. A steam pipe 11 is provided at the inner wall of the drying machine 1. The steam pipe 11 is connected with a steam conduit 12-1 having a steam valve 12. The steam valve 12 is controlled in response to an output signal from a control circuit 16 so that the moisture of the tobacco leaves is maintained constant via an adjustor 17. The control circuit 16 receives signals from a weight meter 13 and pre-moisture meter 14 which are provided at a pretreatment line and a signal from a post-moisture meter 15 which are provided at a post-treatment line. The afore-mentioned structure is known in the art of tobacco leaves treatment.

Figure 2:
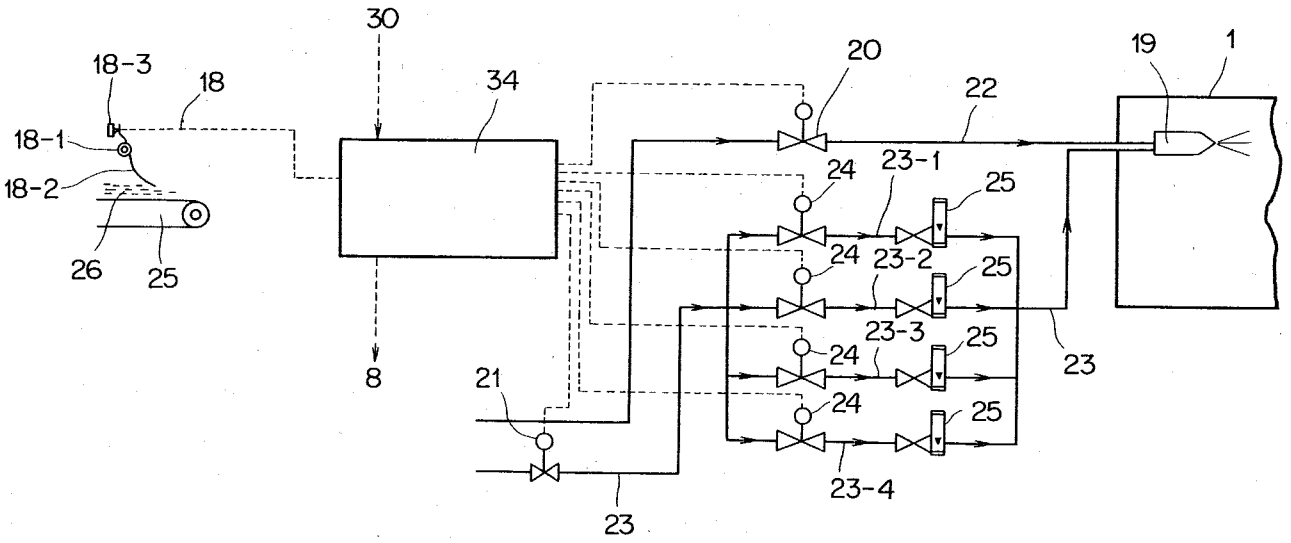
FIG. 2 is a diagram showing the flow of raw material and the signals to and from a control circuit.
Figure 3:
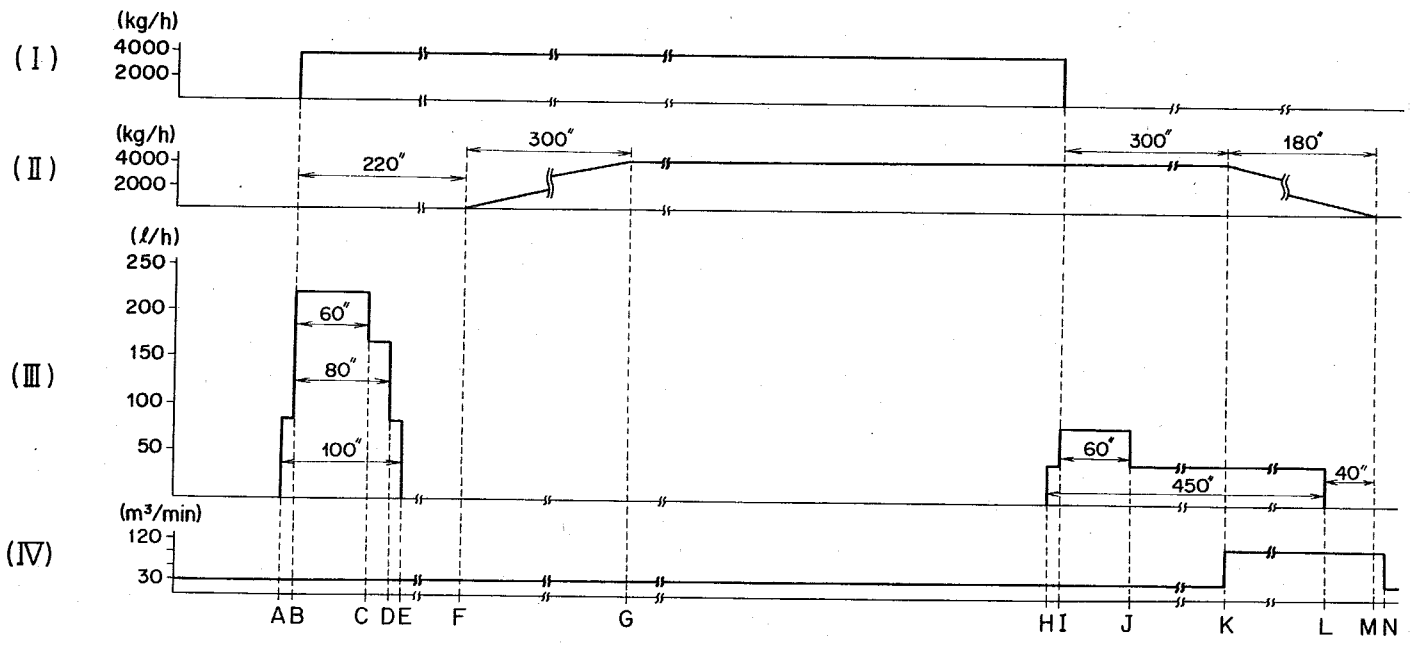
FIG. 3 is a time chart consisting of four graphs I, II, III and IV indicating the relationship between the amounts shown in said graphs wherein the flow rate of raw material charged into the entrance of the drying is plotted in graph I, the flow rate of raw material discharged from the exit of the drying machine in graph II, the flow rate of the sprayed water in graph III and the flow rate of heated air in graph IV.

A detector 18 for detecting the tobacco material is provided on a belt conveyor 26 at the pretreatment line of the drying machine 1. A water spraying nozzle 19 is provided at the entrance of the drying machine 1. The water spraying nozzle 19 is connected with a carrying pressurized air pipe 22 and a water pipe 23 as shown in FIG. 2. The pressurized air pipe 22 is provided with a solenoid valve 20. The water pipe 23 is provided with a solenoid valve 21 and is branched into four pipes 23-1, 23-2, 23-3, 23-4 and is then connected with the water spraying nozzle 19. Each of the branch pipes 23-1, 23-2, 23-3 and 23-4 is provided with a solenoid valve 24 and a constant flow rate valve 25. The detector comprises a lever 18-2 which is pivotally mounted on a fulcrum shaft 18-1 and a microswitch 18-3 for detecting the position of the lever 18-2. The signal from the microswitch 18-3 is input to a control circuit 34. An initializing signal 30 for an entire process line where the drying machine 1 is installed is input to the control circuit 34. When the initializing signal 30 is input the control circuit 34 is adapted to generate a signal for opening the solenoid valves 20 and 21. The control circuit 34 furthermore includes a plurality of timers which are actuated by an input signal from the detector 18. The timers comprise a general electronic circuit which generates a signal to the solenoid valve and the fan 8 so that the amount of the sprayed water and the amount of the heated air as shown in FIG. 3 is obtained.

The timing relationship between the input and output signals will be described in the following operation description with reference to FIG. 3.

When the front end of the flow of the tobacco leaves which have been chipped by a chipping machine (not shown) reaches at the belt conveyor 26 to lift the lever 18-2 of the detector 18, a signal from the microswitch 18-3 is input to the control circuit 34. The signal provides a reference signal for enabling the timer to operate on arrival of the front end of the flow. The control circuit 34 provides an output signal for opening the solenoid valves provided at the branch lines 23-1 and 23-2 when a predetermined period of time has passed since the front end reference signal is input (represented by a point A in FIG. 3). The water which has passed the constant flow rate valves 25 of the branch lines 23-1 and 23-2 is sprayed from the water spray nozzle 19 into the drying machine 1. The timing of the point A is preset about 10 seconds prior to the timing point B at which the front end of the tobacco flow reaches at the drying machine 1. At the timing point B an output signal for opening the solenoid valves 24 at the branch lines 23-3 and 23-4 is generated and the water which has passed the constant flow rate valves 25 of the branch lines 23-3 and 23-4 and the water which has passed the constant flow rate valves 25 of the branch lines 23-1 and 23-2 is sprayed into the drying machine 1 from the water spray nozzle 19. A timing point C which is about 60 seconds after the point B, an output signal is generated for closing the solenoid valve 24 of the branch line 23-4. At a timing point D which is about 20 seconds after the point C, a signal is generated for closing the solenoid valve 24 of the branch line 23-3. A timing point E which is about 10 seconds after the point D, an output signal is generated for closing the solenoid valves 24 of the branch lines 23-1 and 23-2. This causes the flow rate of the sprayed water to stepwise decrease and the spraying of water is stopped.

When the chipping has been completed and the rear end of the tobacco leaves flow has passed the belt conveyor 26 so that the lever 18-2 of the detector 18 is lowered, a signal from the microswitch 18-3 is input to the control circuit 24. This signal becomes a reference signal for timer operation on arrival of the rear end.

When a predetermined period of time has passed since the input of the rear end reference signal (at point H in FIG. 3) the control circuit 24 generates an output signal for opening the solenoid valve 24 in the branch line 23-1 to start water spraying. The timing of the point H is preset about 10 seconds prior to a timing point I at which the rear end of the tobacco material reaches at the drying machine 1. At the timing I an output signal is also generated for opening the solenoid valve 24 in the branch line 23-2 to increase the flow rate of the sprayed water. At the timing point I, an output signal is generated for opening the solenoid valve of the branch line 23-2 to increase the flow rate of the sprayed water. At a timing point J which is about 60 seconds after the point I, an output signal is generated for closing the solenoid valve 24 of the branch line 23-2. At a timing point L which is about 6 minutes and 20 seconds after the point J an output signal is generated for closing the solenoid valve 24 of the branch line 23-1. It causes the amount of the sprayed water to stepwise decrease to stop the spraying. An output signal is generated to the fan 8 for increasing the amount of the air for about three minutes between a timing point K which is about 5 minutes after the point I and a point N. This causes the tobacco leaves which stay in the drying machine to be expelled in an direction to the exit by means of the fan 8. The point K is timed with a time when the tobacco leaves begin to flow from the exit of the drying machine 1. The timing of the point N is preset slightly after the timing point M at which the flow of the tobacco leaves from the exit of the drying machine 1 is completed.

The tobacco leaves which have flowed into the entrance of the drying machine since the point B, are conveyed by the rotation of the drying machine 1 and then begins to be discharged from the drying machine 1 from the point F and then establishes a constant flow rate at a point G. The flow rate of the discharged tobacco leaves is decreased from a point K which is a predetermined period of time after the point I where the supply of the tobacco leaves to the drying machine 1 is stopped and the discharge is finished at a point M.

Water is sprayed into the drying machine 1 from the water spray nozzle 19 from the point A which is prior to the unsteady state at the front end between the points B and C to the point E so that the excessive drying of the tobacco leaves is prevented. Water is sprayed into the drying machine 1 from the water spray nozzle 19 from the point H which is prior to the unsteady state at the rear end flow between the points I and M to the point L so that the excessive drying of the tobacco leaves is prevented. The flow rate of the heated air blown from the fan 8 is increased from points K to N, so that the period of unsteady state of the tobacco leaves is shortened to one-half of that in conventional art.

Accordingly the flow rate of the excessively dried tobacco leaves which were inevitable can be remarkably reduced.

Although the flow rate control for the water spraying is accomplished by a combination of a plurality of the solenoid valve 24 and the flow rate adjust valve 25 in the present embodiment, the same control may be accomplished by means of a diaphragm valve in stead of the solenoid valves and a flow rate adjust valve 25. In this case, the flow rate may be stepwise changed. The signal from the weight meter 13 may be used as a reference signal for control circuit 24 in lieu of the signal from the detector 18.

What is claimed is:

1. A tobacco drying apparatus having a drying unit of rotary cylindrical type, a steam pipe at the wall thereof, a heated air source at the lower side thereof adjacent a material supply inlet, and an outlet, said apparatus comprising:

(a) means for detecting the flow of tobacco raw material at a pretreatment process line of the apparatus;

(b) a water spraying nozzle at the raw material supply inlet into which pressurized air is supplied as a carrier; and (c) a control circuit to:

(1) initiate water spray of predetermined time after detecting the flow of tobacco raw material at said pretreatment line to enable the tobacco raw material to be imminently entering the supply inlet to said unit and to continue said spray for a preselected time; and (2) initiate water spray for a second predetermined time after detecting that the flow of tobacco raw material at said pretreatment line has ceased to enable the tobacco raw material to be imminently approaching the outlet of said unit and to continue said spray for a preselected time, whereby excess drying is prevented at the front and rear portions of said tobacco raw material flow.

2. The tobacco drying apparatus as defined in claim 1, in which the water spray nozzle is connected with a water pipe including a plurality of parallel branch pipes through which water flows and an air pipe through which the air flows.

3. The tobacco drying apparatus as defined in claim 2, in which each branch pipe includes a solenoid valve which is controlled by a signal from the control circuit.

4. The tobacco drying apparatus as defined in claim 3, in which the flow rate of the sprayed water is changed by selectively opening the solenoid valves in the parallel branch pipes.

5. The tobacco drying apparatus as defined in claim 4, in which the flow rate of the sprayed water is controlled to provide at least one increase at a preselected time followed by at least one decrease at a preselected time.

6. The tobacco drying apparatus as defined in claim 1, in which the control circuit includes a plurality of timers which control the timing relation of the solenoid valves in the branch pipe.

7. The tobacco drying apparatus as defined in claim 1, in which the detecting means includes a lever which is actuated by the flow of the raw material and a microswitch which is actuated by the lever.

8. A tobacco drying apparatus having a drying unit of rotary cylindrical type, a steam pipe at the wall thereof, a heated air source at the lower side thereof adjacent a material supply inlet, and an outlet, said apparatus comprising:

(a) means for detecting the flow of tobacco raw material at a pretreatment process line of the apparatus;

(b) a water spraying nozzle at the raw material supply inlet into which pressurized air is supplied as a carrier; and (c) a control circuit to:

(1) initiate water spray a predetermined time after detecting the flow of tobacco raw material at said pretreatment line to enable the tobacco raw material to be imminently entering the supply inlet to said unit and to continue said spray for a preselected time; and (2) initiate a signal to said heated air source to increase its flow rate at a second predetermined time after detecting that tobacco raw material has ceased flow at said pretreatment line to enable the tobacco raw material to be imminently approaching the outlet of said drying unit.

9. The tobacco drying apparatus as defined in claim 8, in which the water spray nozzle is connected with a water pipe including a plurality of parallel branch pipes through which water flows and an air pipe through which the air flows.

10. The tobacco drying apparatus as defined in claim 9, in which each branch pipe includes a solenoid valve which is controlled by a signal from the control circuit.

11. The tobacco drying apparatus as defined in claim 10, in which the flow rate of the sprayed water is changed by selectively opening the solenoid valves in the parallel branch pipes.

12. The tobacco drying apparatus as defined in claim 11, in which the flow rate of the sprayed water is controlled to provide at least one increase at a preselected time and at least one decrease at a preselected time.

13. The tobacco drying apparatus as defined in claim 8, in which the control circuit includes a plurality of timers which control the timing relations of the solenoid valves in the branch pipe and a solenoid valve in a pipe connected with the heated air source.

14. The tobacco drying apparatus as defined in claim 8, in which the detecting means includes a lever which is actuated by the flow of the material and a microswitch which is actuated by the lever.

* * * * *